US008454256B2

(12) United States Patent
Kaneoya et al.

(10) Patent No.: US 8,454,256 B2
(45) Date of Patent: Jun. 4, 2013

(54) CARD PRINTING APPARATUS

(75) Inventors: Daisuke Kaneoya, Nakakoma-gun (JP); Toshiro Fujimoto, Minami-Alps (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 12/926,603

(22) Filed: Nov. 30, 2010

(65) Prior Publication Data

US 2011/0083572 A1 Apr. 14, 2011

Related U.S. Application Data

(63) Continuation of application No. 12/003,260, filed on Dec. 21, 2007, now Pat. No. 8,303,201.

(30) Foreign Application Priority Data

Dec. 28, 2006 (JP) ..... 2006-353859

(51) Int. Cl.
*B41F 35/00* (2006.01)
*B41J 29/17* (2006.01)

(52) U.S. Cl.
USPC ..... 400/701; 101/423; 101/425

(58) Field of Classification Search
USPC . 101/423, 425; 400/701, 702, 702.1; 347/172
See application file for complete search history.

(56) References Cited

U.S. PATENT DOCUMENTS 5,588,763 A * 12/1996 Nubson et al. ..... 400/700
6,554,512 B2 * 4/2003 Heno et al. ..... 400/625
6,762,780 B2 * 7/2004 Tsuruta et al. ..... 347/171
6,916,081 B2 * 7/2005 Nakashima ..... 347/32
7,018,117 B2 * 3/2006 Meier et al. ..... 400/208
7,170,537 B2 * 1/2007 Helma et al. ..... 347/171
7,871,213 B2 * 1/2011 Lodwig et al. ..... 400/208
7,934,881 B2 * 5/2011 Lodwig et al. ..... 400/208

FOREIGN PATENT DOCUMENTS

JP H09-150983 A 6/1997
JP 10-059600 * 3/1998
JP H10-324432 A 12/1998
JP 2000-313153 * 11/2000
JP 2001-10164 A 1/2001
JP 2001-63893 * 3/2001
JP 2003-39717 A 2/2003
JP 2004-106222 * 4/2004
JP 2004-106222 A 4/2004
JP 02004106222 * 4/2004

* cited by examiner

*Primary Examiner* — Matthew G Marini
*Assistant Examiner* — Marissa Ferguson Samreth
(74) *Attorney, Agent, or Firm* — Manabu Kanesaka

(57) ABSTRACT

A card printing apparatus for sequentially printing a plurality of colors on a card has a card supply unit for supplying a card; a card conveyance path provided linearly from the card supply unit for conveying the card; a conveyance device provided on the card conveyance path for conveying the card; a printing unit provided on the card conveyance path; a card cleaning member disposed between the card supplying unit and the printing unit provided within the returning range of the card while printing the card conveyed in reverse; and a card cleaning member moving device for moving the card cleaning member to a retreated position separated from the card cleaning member and the card conveyance path, and an operating position. The card cleaning member is moved to the retreated position when the card is conveyed in reverse while printing.

6 Claims, 7 Drawing Sheets

CARD PRINTING APPARATUS

CROSS-REFERENCE TO RELATED APPLICATIONS

The present application is a continuation application of U.S. Ser. No. 12/003,260 filed on Dec. 21, 2007 now U.S. Pat. No. 8,303,201. The application claims priority to Japanese patent application No. 2006-353859 filed on Dec. 28, 2006, which is incorporated by reference in its entirety.

BACKGROUND OF THE INVENTION AND RELATED ART STATEMENT

The present invention relates to card printing apparatuses; more particularly, the present invention relates to a card printing apparatus that removes dirt and dust adhering to a print surface of a card to improve printing quality.

Conventionally, cleaning technology was known for removing dust and dirt and the like adhering to a card printing surface prior to the print process at a printing unit that has a print head when creating a card-shaped recording medium such as a credit card, cash card, license card or ID card and the like. An example of a cleaning technology is disclosed in Unexamined Japanese Pat. Pub. 2848412.

A mechanism that cleans a surface of the member by removing dust and dirt from a surface of the member, specifically which removed dust and dirt adhering to the card printing surface is also disclosed in U.S. Pat. No. 7,018,117B2 and Unexamined Japanese Pat. Pub. 2000-313153.

A technology that cleans the surface of a cleaning member that comes into contact with the card by moving the member which removed the dust and dirt adhering to the card printing surface a plurality of times is disclosed in Pat. Pub. 2848412 and Unexamined Japanese Pat. Pub. 2000-313153.

However, in a case where a card issuing apparatus and a card printing apparatus that create card-shaped media have a function to remove dust and dirt adhering to the card printing surface formed using a roller-shaped member, there is a problem where the dust and dirt removed from the card is transferred to another card. To make the apparatus more compact, it is necessary to position this cleaning device (roller-shaped member) as close to the printing unit as possible in the conveyance path. For example, in an apparatus that print records predetermined images and characters by thermally transferring a plurality of colors (for example, yellow, magenta and cyan, or Y, M, C) to the card using a thermal head, and a thermal transfer film interposed between the card print surface and the thermal head, it is necessary to convey the card in the opposite direction when sequentially printing a next color after the printing of a first color is completed. However, at this time, because the conveyance path is short, the printed card and cleaning mechanism surfaces come into mutual contact which causes ink to soil the surface of the cleaning mechanism. This causes a problem of lowered print quality on the card printing surface.

It is therefore an object of the present invention to provide a card printing apparatus that securely removes dirt and dust adhering to a card printing surface without transferring the removed dust and dirt to the same or a different card. The card cleaning mechanism does not reduce card print quality caused by ink adhering and smudging the surface of the cleaning mechanism.

Further objects and advantages of the invention will be apparent from the following description of the invention.

SUMMARY OF THE INVENTION

A first aspect of the present invention is a card cleaning mechanism equipped with a first card cleaning member that cleans a surface of the card by coming into contact with a conveyed card; and a second card cleaning member that cleans a surface of the first card cleaning member by touching a surface of the first card cleaning member. The first card cleaning member is configured to move between a retreated position separated from the card conveyance path, and an operating position where it touches the surface of the card being conveyed and where it comes into contact with the second card cleaning member by advancing into the card conveyance path.

In the first aspect, the first card cleaning member is configured to move between a retreated position separated from the card conveyance path, and an operating position for coming into contact with a surface of the card being conveyed and the second card cleaning member by advancing into the card conveyance path. For that reason, when a card is supplied, the first card cleaning member is advanced to the operating position on the card conveyance path to clean the surface of the card by coming into contact with a surface thereof (the printing surface), and to have the dust and dirt adhering to its surface be removed by coming into contact with the second card cleaning member. Other than during that time, the first card cleaning member is retreated to the retreat position separated from the card conveyance path so that it can surely remove dust and dirt adhering to the card surface and not to transfer that removed dust and dirt to another card. Also, when this configuration is adopted in a card printing apparatus, it is possible to maintain high quality without a drop in print quality because there is no smudging caused by the adherence of ink.

In the first aspect, the second cleaning member can be arranged at a predetermined position separated from the card conveyance path. A holding unit that holds the first card cleaning member and a drive unit that drives to move the holding unit are provided. The drive unit can directly or indirectly push the holding unit to move the first card cleaning member to the operating position. In such a case, the drive unit has a solenoid and a plunger that advances and retreats by the drive of the solenoid being switched, and it is acceptable to provide a lever member rotatably mounted to an edge of the plunger, and an engaging member that engages the other edge of the lever member, and mount the holding unit on a portion of the engaging member. In this case, the holding unit can be detachably mounted to the engaging member.

In the first embodiment, the first and second card cleaning members are both composed of roller members, and it is preferable that the roller diameter of the second card cleaning member roller be smaller than the diameter of the roller of the first card cleaning member.

To attain the aforementioned object, a second aspect of the present invention which is a cleaning method is provided. This aspect contains the processes of moving the first card cleaning member to an operating position where it is positioned to come into contact with a card being conveyed; applying a first cleaning where the first card cleaning member cleans a surface of the card being conveyed over the card conveyance path; applying a second cleaning where the second card cleaning member cleans a surface of the first card cleaning member by coming into contact with the first card cleaning member; detecting a card when a card is conveyed; and moving the first card cleaning member to the retreated position separated from the card conveyance path, using the card detection at the card detection process as a trigger. These processes are repeated for each card being conveyed over the card conveyance path. The second aspect repeats the operation position moving process, the first cleaning process, the second cleaning process, the card detection process and the retreated position moving process for each card being conveyed over the card conveyance path, so dust and dirt adhering to the card surface is surely removed. That removed dust and dirt is not retransferred to a different card. Also, when these processes are adopted for a card printing apparatus, ink does not become smudged or smeared, so print quality of the card is not reduced and quality is maintained. In this aspect, it is preferred that the first and the second cleaning processes are applied at the same time.

To attain the aforementioned object, a third aspect of the present invention, a card printing apparatus equipped with a first card cleaning member that cleans a surface of the card by coming into contact with a conveyed card; and a second card cleaning member that cleans a surface of the first card cleaning member by touching the surface of the first card cleaning member, is provided. The apparatus has a card cleaning mechanism wherein the first card cleaning member is configured to move between a retreated position that is separated from the card conveyance path and an operating position where it touches the surface of the card being conveyed and where it comes into contact with the surface of the second card cleaning member by advancing into the card conveyance path, and a printing unit that prints characters and images to the card whose surface was cleaned by the card cleaning mechanism. With the third aspect, dust and dirt adhering to the card surface is surely removed and not retransferred to a different card, and the ink does not become smudged. Therefore, card image print quality is not reduced and high quality is maintained.

Further, according to the third aspect of the present invention, the printing unit has an ink media that forms characters and images and at least a cartridge that houses the ink media. The second card cleaning member can be fastened to a portion of the cartridge at a predetermined position separated from the card conveyance path. A holding unit that holds the first card cleaning member and a drive unit that drives to move the holding unit, and a control unit that controls the drive unit are provided. The drive unit can directly or indirectly push the holding unit to move the first card cleaning member to the operating position. In such a case, the control unit controls the drive unit according to print execution commands for each card, and can move the first card cleaning member from the retreated position to the operating position. Also, a detection member disposed between the card cleaning mechanism and printing unit detects a card that is being conveyed. The control unit controls the drive by using the detection of the card by the detection member as a trigger and moves the first card cleaning member from the operation position to the retreated position. Also, a card discharge outlet is provided to discharge the card printed at the printing unit. The card is conveyed toward the card discharge outlet, and the control unit controls the drive of the drive unit so that the first card cleaning member is held at the retreated position. Also, a card supply unit that supplies blank cards (prior to being printed at the printing unit) is provided. The first and the second card cleaning members are disposed between the card supply unit and printing unit.

DETAILED DESCRIPTION OF PREFERRED EMBODIMENTS

The following will now explain an embodiment of the present invention applied to a printer apparatus that has a function to print record characters and images to a card-shaped recording medium (hereinafter simply referred to as a card), and a function to magnetically record information to a magnetic strip portion on the card, with reference to the drawings provided.

Figure 7:
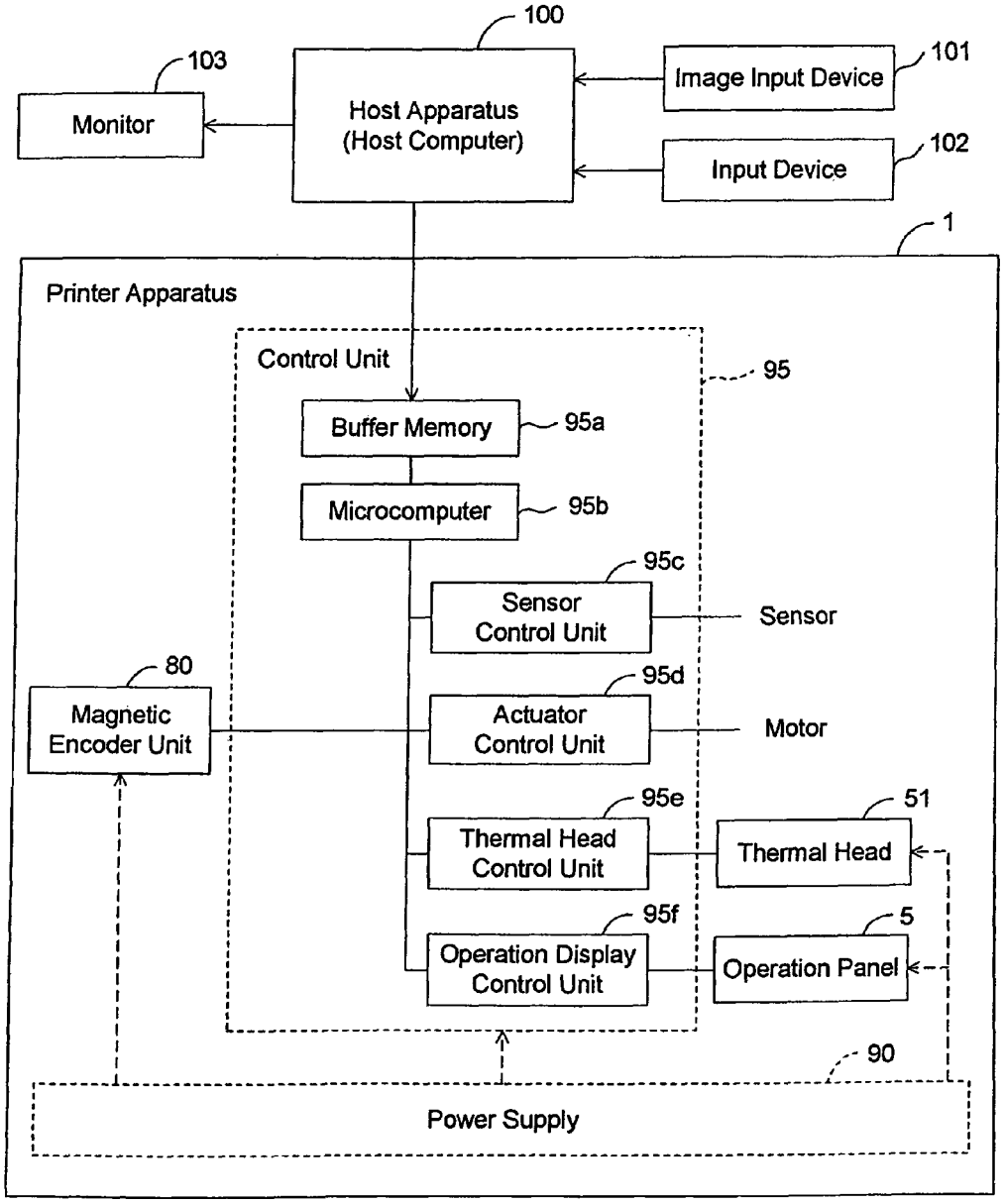
FIG. 7 is a block diagram of the general configuration of the printer apparatus according to the present invention.

As shown in FIG. 7, the printer apparatus 1 of this embodiment of the present invention is connected to a host apparatus 100 (for example, a host computer such as a personal computer or the like) via an interface (not shown). The host apparatus 100 provides instructions such as recording operations and the like by sending print recording data and magnetic recording data to the printer apparatus 1. Note that the printer apparatus 1 has an operation panel (operation display unit) 5 (see FIGS. 7 and 1). Therefore, in addition to the recording operation instructions sent from the host apparatus 100, recording operation instructions can also be designated using this operation panel 5.

Generally, an image input device 101 such as a scanner or the like that reads and records original images; an input device 102 such as a keyboard and mouse and the like that inputs instructions and data to the host apparatus 100; and a monitor 103 such as a liquid crystal display that displays data generated using the host apparatus 100 are connected to the host apparatus 100.

Figure 1:
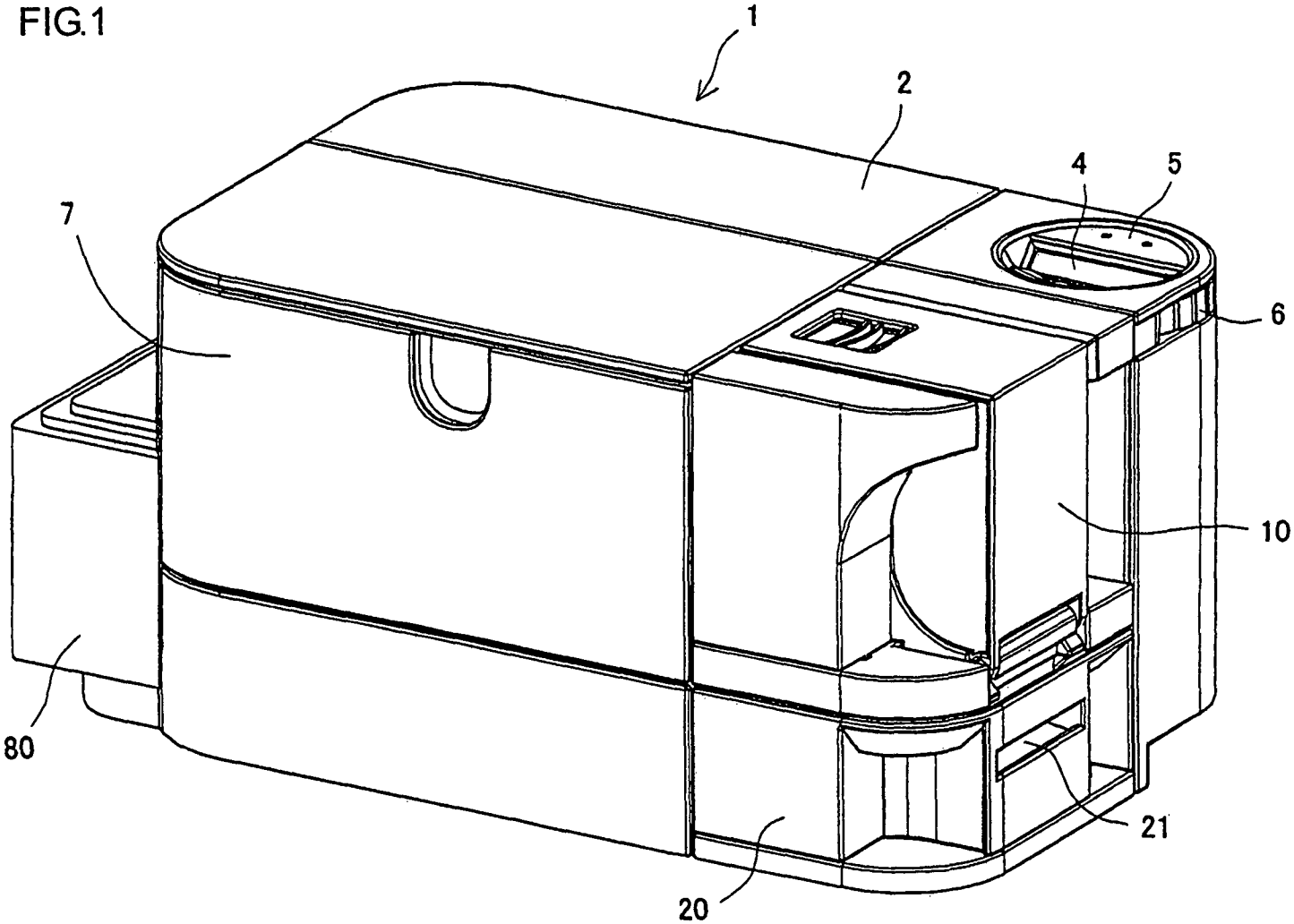
FIG. 1 shows an external perspective view of a printing apparatus of an embodiment that applies the present invention.

As shown in FIG. 1, the printer apparatus 1 according to this embodiment has a card supply unit 10 detachably mounted to a casing 2 at one side thereof, that can store a plurality of blank cards prior to recording in a stack shape (approximately 100 cards); a card storage unit 20 detachably mounted to the casing 2 at one side thereof, that can store recorded cards in an oblique state (approximately 30 cards) equipped below the card supply unit 10; a display unit 4 that displays operating states including any errors that could occur on the printer apparatus 1, at a position adjacent to the card supply unit 10 at one side of the same casing 2, and an operation panel 5 for making various settings such as the print and magnetic recording processes. Note that the operation panel 5 is provided to rotate in synchronization to the rotation of a dial 6.

A card discharge outlet 21 formed as an opening to discharge recorded cards to outside of the apparatus is provided at one portion of the card storage unit 20 so that the cards can be discharged from the apparatus when the card storage unit 20 is full. Also, an opening cover 7 is provided at one surface of the printer apparatus 1 to allow access to inside the apparatus to detach a cartridge 52 (FIG. 2) that houses an ink ribbon R, described below, used to print record. The opening cover 7 composes a portion of the casing 2.

At another side of the casing 2 a magnetic encoder unit 80 is disposed with a portion thereof projecting into the casing 2 opposing the card supply unit 10 and card storage unit 20.

Figure 2:
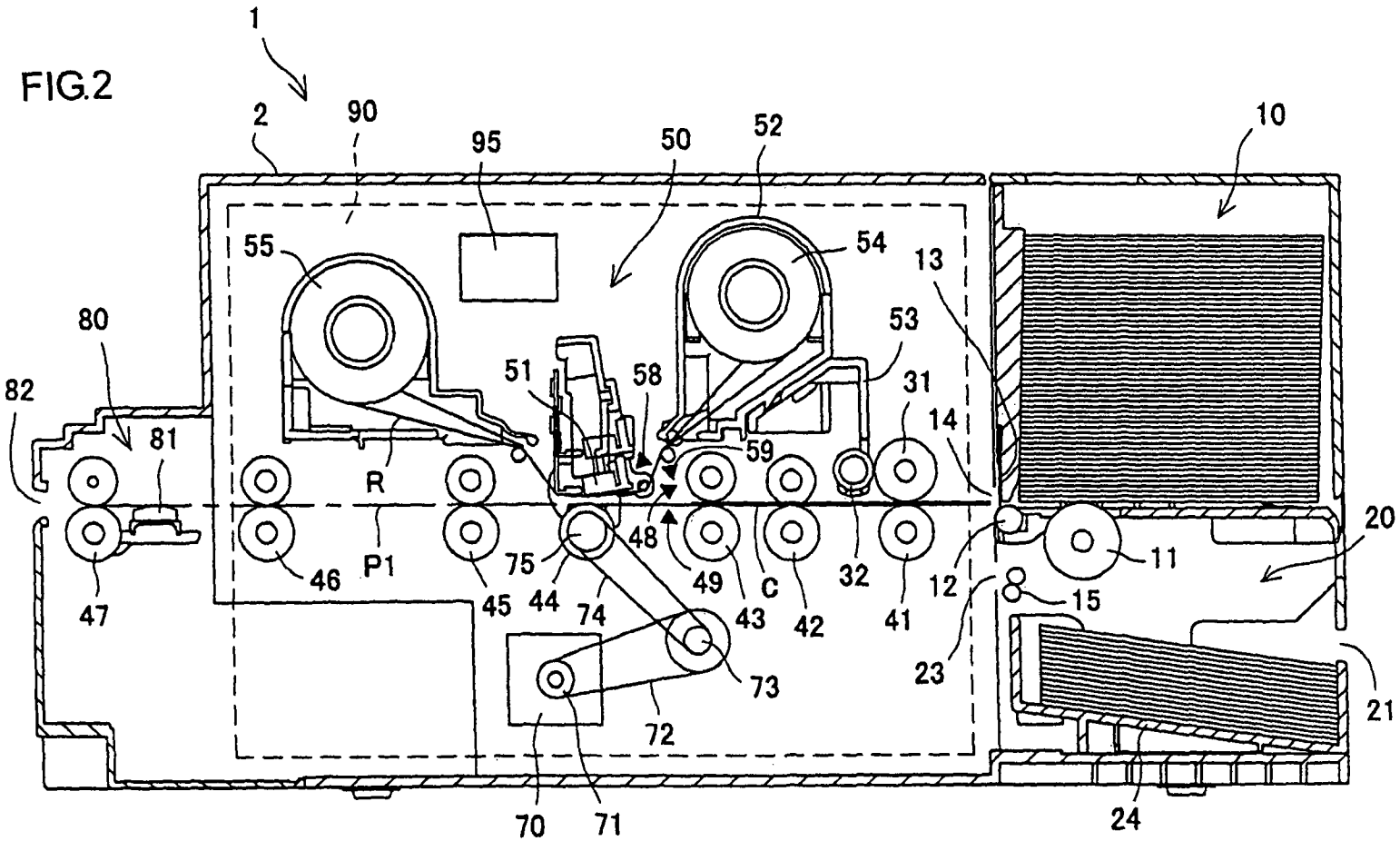
FIG. 2 is a schematic sectional view of a blank card prior to the recording process being conveyed in a printer apparatus of the embodiment.
Figure 3:
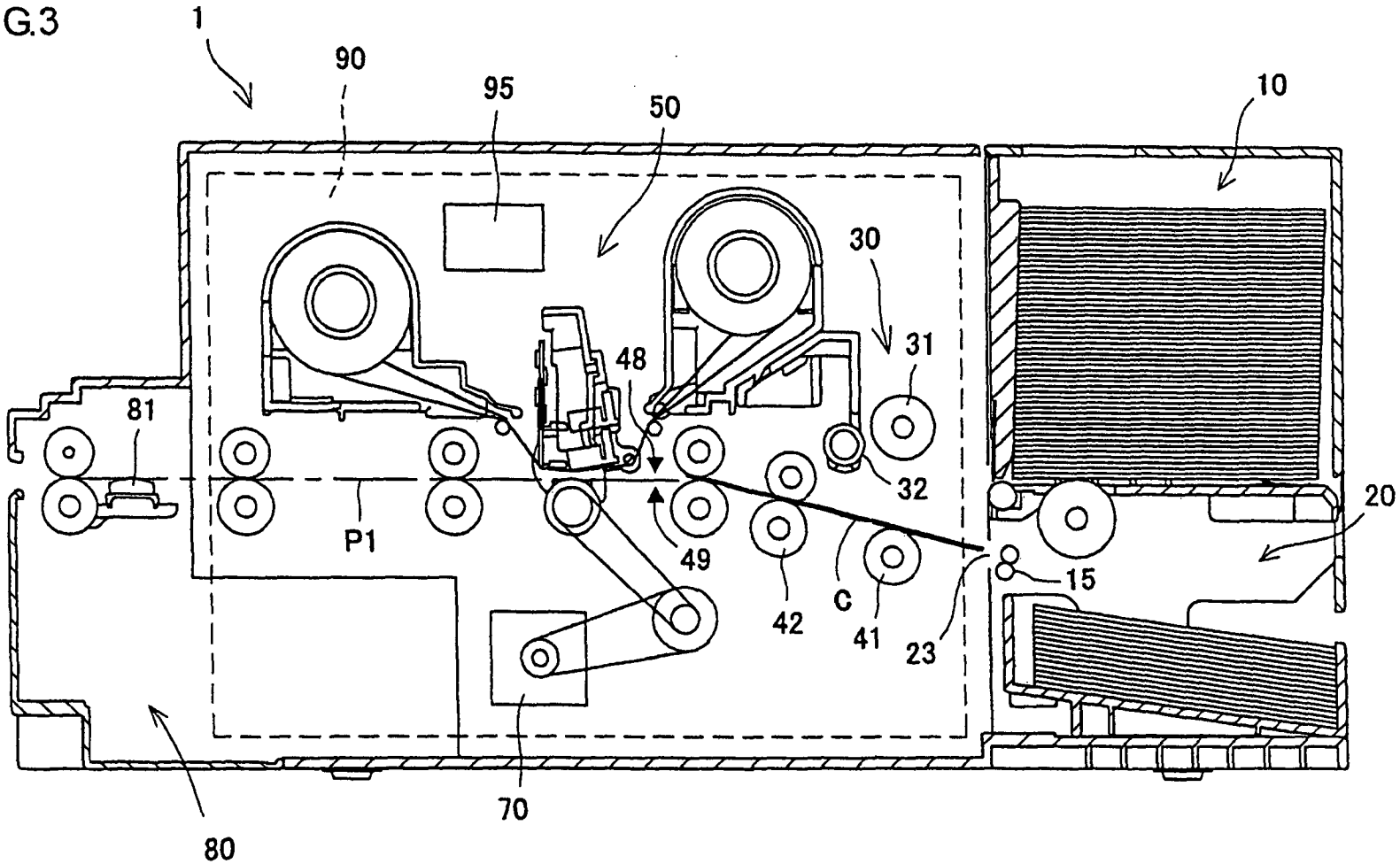
FIG. 3 is a schematic sectional view of the card after the recording process being discharged in a printer apparatus of the embodiment.

The following will now explain each composing element inside the printer apparatus 1 with reference to FIGS. 2 and 3. Note that FIG. 2 shows a blank card C prior to being recorded supplied from the card supply unit 10 and conveyed toward a printing unit 50. FIG. 2 also shows a cleaning roller 31 for cleaning the printing surface of the conveyed card C as a first card cleaning member of the card cleaning mechanism 30, described below, by coming into contact with the surface of the card C.

FIG. 3 shows the card C recorded at the printing unit 50 and the magnetic encoder unit 80 being conveyed toward the card storage unit 20. At that time, conveyance rollers 41 and 42 maintain the card C in a conveyable state toward the card discharge outlet 23 by shifting from a first position that forms a substantially horizontal card conveyance path to a second position that forms an oblique card conveyance path using a moving mechanism 60, described below.

The card supply unit 10 is detachably provided at one side of the printer apparatus 1 and stores inside a plurality of blank cards prior to processing, and has a supply roller 12 and separating gate 13 composed of a plate-shaped member to allow the passage of only one card C when a supply roller 11 established on the apparatus side (printer apparatus 1) is rotatably driven by a motor, not shown, to supply a bottom-most card (the card at the bottom of the stack) into the apparatus. The supplied card C passes the supply roller 12 and the separating gate 13 and is guided to a card supply opening 14 opened at one side of the casing to link with the card supply unit 10. Note that a flexible pad, not shown, is positioned at a bottom edge of the separating gate 13. For example, even in a case of supplying cards having different thicknesses, it is still possible to separate cards into a single card for supply.

The card storage unit 20 is detachably installed below the card supply unit 10 at one side of the printer apparatus 1 (casing 2) and stores recorded cards C in an oblique state. A storage tray 24 at a bottom surface therein formed to an oblique state is provided in the card storage unit 20. The card storage unit 20 has an opening below the card supply opening 14 at one side of the casing 2 to store the recorded card C sequentially discharged by a discharge roller 15 from the card discharge outlet 23. (See FIG. 3)

The discharge roller 15 is fastened to the printer apparatus 1 side. A motor, not shown, that rotatably drives the supply roller 11 rotatably drives the discharge roller 15, but in the case where the supply roller is rotating in a direction to supply a blank card C, the reverse drive of the motor, not shown, rotatably drives to discharge the card C to the storage tray 24. Specifically, the supply roller 11 and discharge roller 15 are rotated by the forward and reverse drives of the motor, not shown, but because a one-way clutch, not shown, is installed in the supply roller 11, it is possible to rotate only in the card feeding direction (rotational drive is not transmitted in a direction reverse to the card feeding direction because of the one-way clutch). On the other hand, the discharge roller 15 is rotatably driven in both directions by the forward and reverse drives of the motor, not shown. In this embodiment, the supply operation for blank cards C that have not been recorded and the discharge operation for recorded cards C do not occur at the same time. Therefore, the rotation for discharging the card C by the discharge roller 15 and the rotation in a direction opposite to that are not hindered.

The card C supplied from the card supply opening 14 is conveyed along the substantially horizontal card conveyance path P1 being sequentially handed over to the conveyance rollers 41, 42 and 43 having driving force transmitted from the conveyance drive motor 70, described below. Note that the conveyance rollers 42 and 43 are composed of a pair of rollers having a drive roller and a follower roller. (Hereinafter, unless a different explanation is provided, the explanation will focus only on the drive roller, omitting an explanation of the follower roller of the pair of rollers.)

At an opposite side of the conveyance roller 41, the cleaning roller 31 that composes a portion of the card cleaning mechanism 30 described below is positioned to advance to and retreat from the card conveyance path P1 to oppose the conveyance roller 41. When the cleaning roller 31 is advanced toward the card conveyance path P1 to touch the conveying card C (see the state shown in FIG. 2), the card C is gripped between the cleaning roller 31 and the conveyance roller 41 that has drive force, thereby removing foreign matter such as dust and dirt from the print surface to be printed at the printing unit 50.

When the cleaning roller 31 advances to toward the card conveyance path P1, where the roller operates, the cleaning roller 31 is positioned to touch the surface of a roller-shaped cleaner 32. The roller-shaped cleaner 32 is positioned at a predetermined position away from the card conveyance path P1 adjacent to the cleaning roller 31. The roller-shaped cleaner 32 has a cleaning roller with a smaller diameter (roller diameter) than the outer diameter (roller diameter) of the cleaning roller, and is rotatably mounted to a support member 53 detachably installed at a predetermined position of a cartridge 52 that houses an ink ribbon R as ink media that composes a portion of the printing unit 50.

According to this embodiment, the cleaning roller 31 is composed of rotatable roller-shaped member, the surface thereof being made of a rubber material having an adhesive property. Also, the roller-shaped cleaner 32 is wrapped with an adhesive tape having a sponge layer on the resin, forming a rotatable roller-shaped member. Because the adhesive tape has a higher adhesive property than the adhesive property of the cleaning roller 31 surface, foreign matter such as dust and dirt removed from the card C and adhering to the cleaning roller 31 surface is shifted to the adhesive tape that forms the surface of the cleaning roller 32 by mutual contact of both surfaces.

At a downstream side in the direction of card conveyance of the conveyance roller 43, the printing unit 50 that print records predetermined characters and images to the surface of the card C cleaned by the cleaning roller 14 is established.

The printing unit 50 of this embodiment adopts the configuration of a thermal transfer type printer. This unit has a thermal head 51 provided to advance and retreat with regard to a platen roller 44 established at a printing position on the card conveyance path P1. The ink ribbon R having a plurality of colors of an ink layer Y (yellow), M (magenta), C (cyan), and Bk (black) and the like repeated sequentially on its surface interposes the platen roller 44 and the thermal head 51. This ink ribbon R is housed in the cartridge 52 as described above.

When thermally transfer-recording information such as characters or images and the like to the card C moving along the card conveyance path P1, the ink ribbon R is supplied from the ribbon supply reel 54 and conveyed to the leading end of the thermal head 51 while touching substantially the entire surface thereof and is taken up by a take-up ribbon reel 55. The ribbon supply reel 54 and the ribbon take-up reel 55 are rotatably driven by a motor, not shown. At that time, the ink ribbon R interposes the thermal head 51 and the card C top surface. The ink ribbon R presses against the thermal head 51 while heating elements in the thermal head 51 are selectively operated to print predetermined characters and images to the card C. A plurality of guide shafts, and a transmissive type sensor composed of a light-emitting element 58 and a light-receiving element 59 that detects the ink layer Bk (black) to align the top of a predetermined ink layer (in this embodiment, the ink layer Y) are provided in the ink ribbon R conveyance path.

A transmissive type sensor (hereinafter referred to as a card detection sensor) composed of a light-emitting element 48 and a light-receiving element 49 that detects a leading edge and a trailing edge in the direction of conveyance of the card C conveyed along the conveyance path P1 is disposed in an upstream side (the conveyance roller 43 side) in the direction of conveyance of the card of the thermal head 51.

A conveyance drive motor 70 composed of a stepping motor capable of both forward and reverse drives to rotatably drive the series of conveyance rollers 41, 42 and 43 and the platen roller 44 is disposed below the printing unit 50. A pulley 71 mounted on the rotating shaft of the conveyance drive motor 70 transmits the rotational driving force of the conveyance drive motor 70 to the pulley 73 by the belt 72, and drive is transmitted to the platen roller 44 by the belt 74 one end thereof trained on the pulley 73, via the pulley 75 disposed on the rotating shaft of the platen roller 44. Note that the pulley 73 is composed of a two-step pulley. The belt 72 and the belt 74 are trained at the stepped portion.

A plurality of gears, not shown, is disposed on the rotating shaft of the platen roller 44 and the conveyance rollers 41, 42 and 43, and between each of the rollers. Rotational driving force transmitted to the platen roller 44 is transmitted to each of the conveyance rollers 41, 42 and 43 via the plurality of gears.

A nip roller 45 that nips the card C while print recording thereto by the printing unit 50 has a function to convey the card C to a downstream side in the conveyance direction (the ribbon take-up reel 55 side) of the platen roller 44 is disposed along the conveyance path P1. Further downstream of this nip roller 45 in the direction of card conveyance, a feed roller 46 is disposed to convey the card C along the same conveyance path P1.

Gears, not shown, are mounted on these nip roller 45 and feed roller 46. Also, a plurality of gears is disposed between the platen roller 44 and nip roller 45, and the nip roller 45 and the feed roller 46. The plurality of gears, not shown, mutually mesh to transmit the rotational drive force from the conveyance drive motor 70 to the nip roller 45 and the feed roller 46 by branching from the gear disposed on the rotating shaft of the platen roller 44 via drive force transmission mechanism including the pulleys, belts and plurality of gears, not shown. Note that the nip roller 45 and the feed roller 46 are configured to nip the card C in a stopped state when the magnetic encoder unit 80 magnetically records to a magnetic strip disposed on a back side of the print surface of the card C.

The magnetic encoder unit 80 is disposed adjacent to the feed roller 46 downstream of the printing unit 50 in the direction of card conveyance. A reciprocating (self-propelled) magnetic head 81 that scans along the conveyance path P1 is disposed in the magnetic encoder unit 80 to magnetically record to the magnetic strip of the card C held in a stopped state by the nip roller 45 and the feed roller 46. Note that the magnetic encoder unit 80 is configured to have a microcomputer to control the magnetic recording process of the magnetic head 81.

A card conveyance outlet 82 formed as an opening to discharge the card C conveyed along the conveyance path P1 to outside of the apparatus is provided at one portion of the magnetic encoder unit 80. Specifically, this card conveyance outlet 82 is provided on an extended line of the conveyance path P1 at the other side of the casing 2 opposite to the card supply opening 14.

A conveyance out roller 47 that conveys out the card C toward the card conveyance out outlet 82 and out from the card conveyance out outlet 82 is disposed in the magnetic encoder unit 80. There is no drive source provided in the magnetic encoder unit 80 to rotatably drive the conveyance out roller 47, but a plurality of gears, not shown, are provided and linked between the conveyance out roller 47 and feed roller 46 to transmit rotational driving force transmitted to the feed roller to the conveyance out roller 47.

Therefore, the printer apparatus 1 has a configuration that provides the card supply opening 14, the printing unit 50 and the magnetic encoder unit 80 along a substantially horizontal card conveyance path P1 connected from the card supply unit 10.

As is clearly shown in the drawing, the magnetic encoder unit 80 has a unit shape portion thereof, to fit into the apparatus. The conveyance drive motor 70 is disposed under the printing unit 50 and between the magnetic encoder unit 80 and the moving mechanism 60 (see FIGS. 4 and 6) that moves the conveyance rollers 41 and 42 to the first and second positions.

Figure 4:
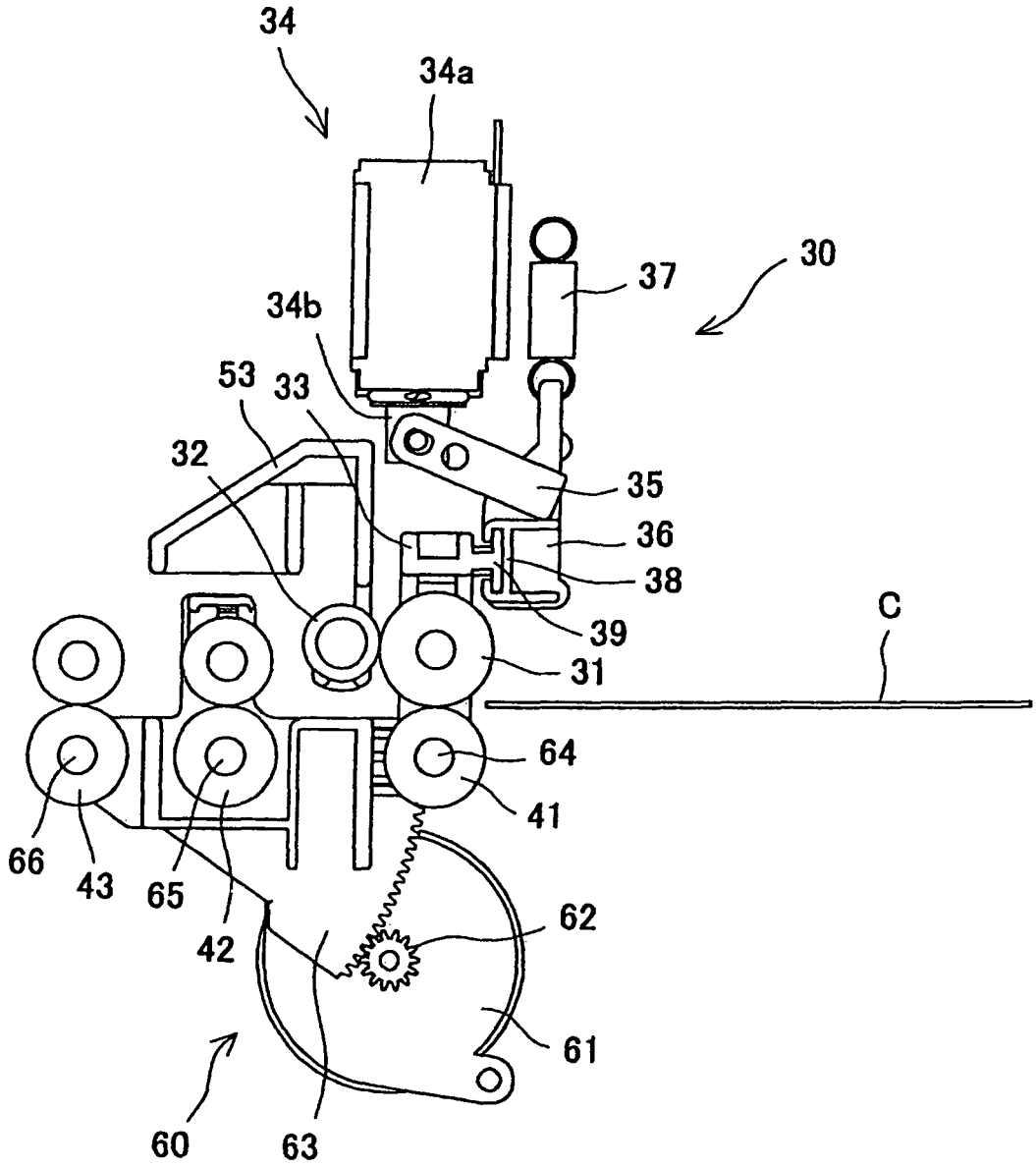
FIG. 4 shows an enlarged view of a portion to explain a conveyance roller moving mechanism and operations of a card cleaning mechanism, and shows a card being conveyed therein.
Figure 5:
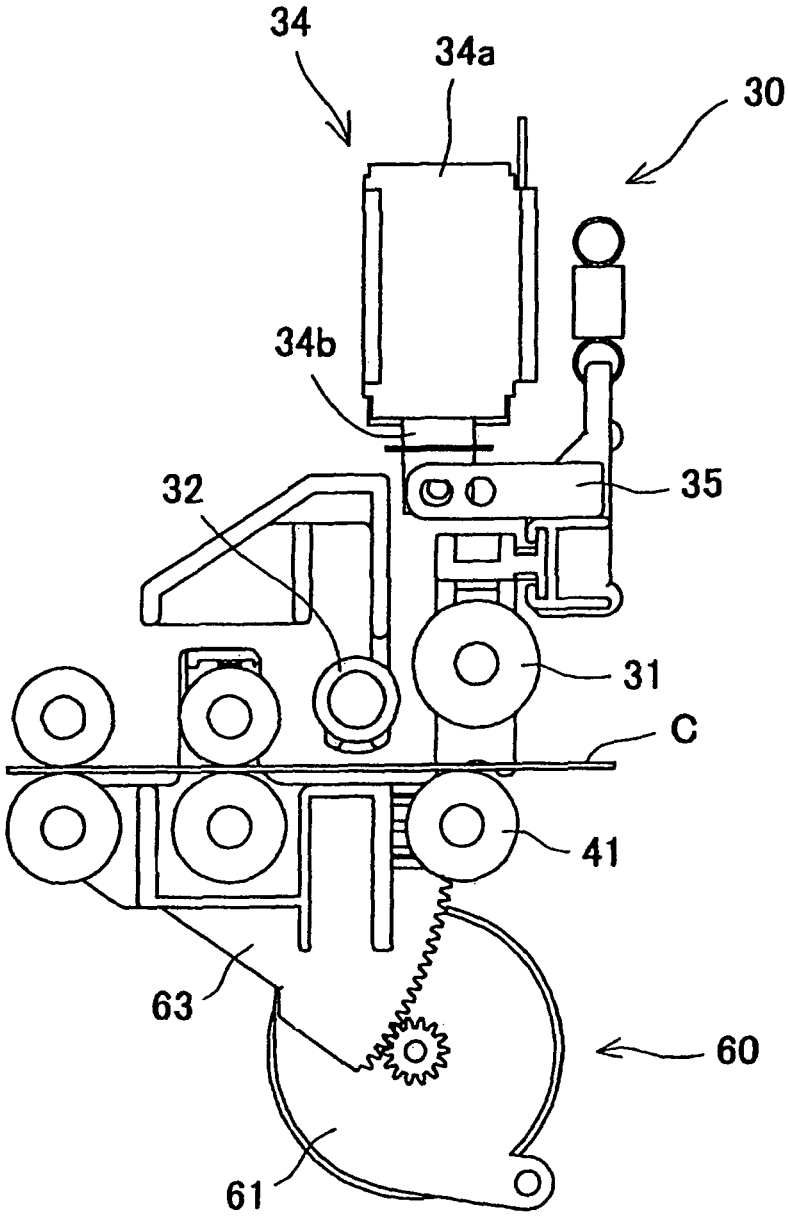
FIG. 5 shows an enlarged view of a portion to explain the conveyance roller moving mechanism and operations of a card cleaning mechanism, and shows the card being conveyed in reverse when sequentially printing a plurality of colors thereupon.
Figure 6:
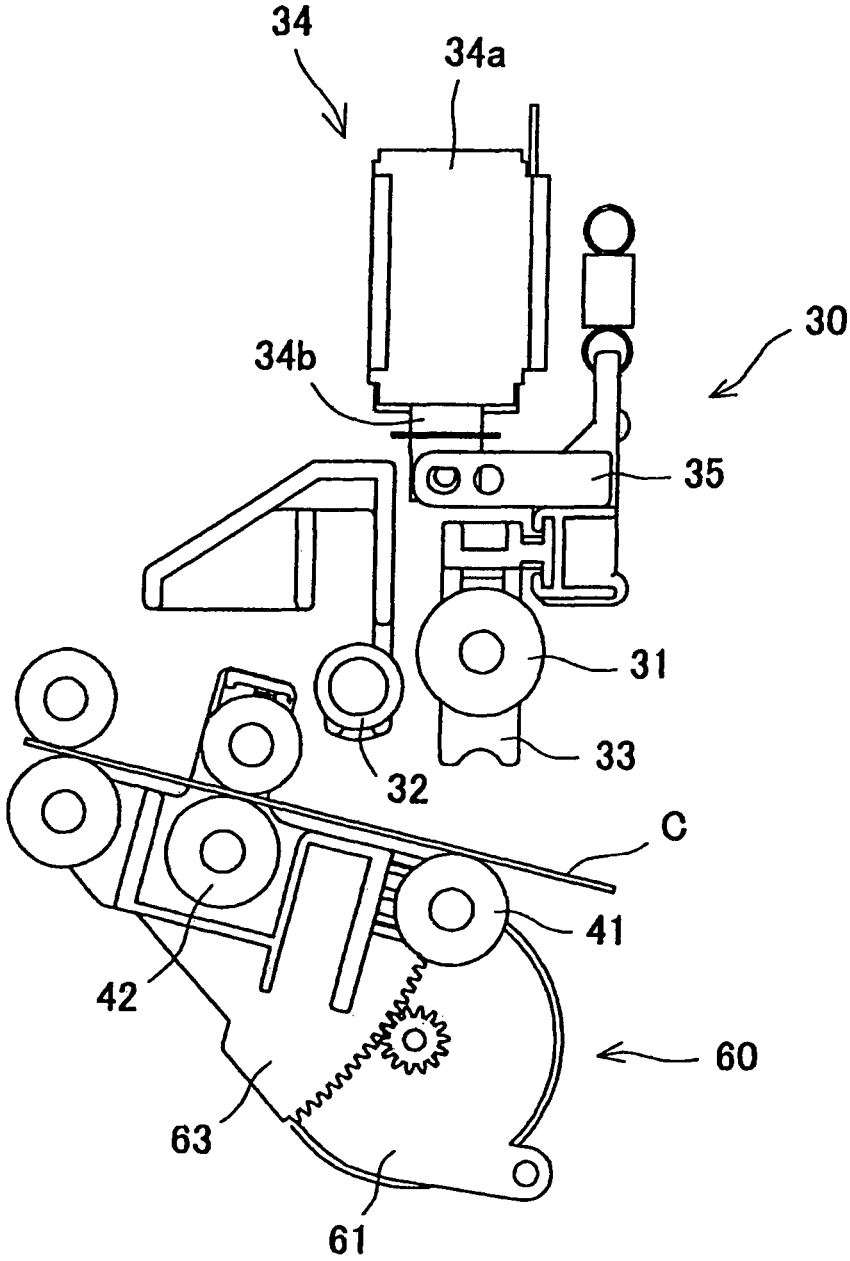
FIG. 6 shows an enlarged view of a portion to explain the conveyance roller moving mechanism and operations of a card cleaning mechanism, and shows the printed card being discharged.

The following will now explain the card cleaning mechanism 30 and the moving mechanism 60 with reference to FIGS. 4 to 6. Note that FIG. 4 shows a card C being received from the card supply opening 14 and just prior to the card C being gripped between the cleaning roller 31 and conveyance roller 41; FIG. 5 shows the card C being conveyed in reverse when sequentially print recording many colors to the print surface of the card C using the printing unit 50; FIG. 6 shows recorded card C being conveyed toward the card discharge outlet 23.

The card cleaning mechanism 30 has an actuator 34 composed of a solenoid 34*a* to enable the cleaning roller 31 to move between an operating position where it can touch the card C and the roller-shaped cleaner 32 (surface contact) by advancing into the card conveyance path P1, and a retreated position that is a home position separated from the conveyance path P1, and a plunger 34*b* that advances and retreats by the drive switch (ON/OFF) of the solenoid 34*a*.

A lever member 35, one end of which is thereof rotatably mounted to an end of the plunger 34*b* is provided, and an engaging member 36 that engages the other end of the lever member 35 is provided. One end of the engaging member 36 is hooked to a tension spring 37 fastened to a predetermined position inside the apparatus; urging force from the tension spring 37 constantly urges the engaging member 36 upward.

The card cleaning mechanism 30 has a holder 33 that holds the cleaning roller 31, and has an integrated configuration where a convex portion 39 formed on a portion of the holder 33 is fit into a concave portion 38 formed on a portion of the engaging member 36. Specifically, the holder 33 that holds the cleaning roller 31 is detachable to the engaging member 36. The card cleaning mechanism 30 has a configuration that includes a roller-shaped cleaner 32 rotatably mounted to a support member 53 detachably installed at a predetermined position of a cartridge 52 that houses an ink ribbon R as a portion of the printing unit 50.

It is to be noted that, when the solenoid 34*a* of the drive unit 34 is driven (drive ON), the lever member 35 pushes the engaging member 36 downward thereby indirectly pushing the holder that holds the cleaning roller 31 downward where the cleaning roller 31 is positioned at the operating position.

As shown in FIGS. 4 to 6, the moving mechanism 60 has a stepping motor 61 as a forward and reverse drive motor, a motor gear 62 mounted on the rotating shaft of the stepping motor 61. A geared bracket 63 has a geared portion that meshes with the motor gear 62. Roller shafts 64, 65, and 66 that support the conveyance rollers 41, 42 and 43 are held by the geared bracket 63.

Because the geared bracket 63 is established to rotate around the roller shaft 66 of the conveyance rollers 43, the moving mechanism 60 allows the conveyance rollers 41 and 42 to move between the first position (a position where the conveyance rollers 41 and 42 form a substantially level card conveyance path; a home position, see FIGS. 4 and 5) and the second position (a position where the conveyance rollers 41 and 42 form an oblique conveyance path; see FIG. 6).

The following will now explain the control and electrical systems of the printer apparatus 1. As shown in FIGS. 2 and 3, the printer apparatus 1 has a control unit 95 that controls overall operations of the printer apparatus 1 and a power unit 90 that converts commercial alternating current into direct current to drive and operate each of the mechanisms and control unit.

As shown in FIG. 7, the control unit 95 comprises the microcomputer 95*b* (hereinafter referred to as the microcomputer 95*b*) that controls the overall processes of the printer apparatus 1. The microcomputer 95*b* is composed of a CPU that operates under a high-speed clock as its central processing unit, a ROM written with basic control operations (programs and program data) of the printer apparatus 1, and RAM as the CPU work area, and internal busses connecting these.

External busses are connected to the microcomputer 95*b*. An interface, not shown, that communicates with the host apparatus 100, and a buffer memory 95*a* that temporarily stores print recording data to be printed on the card C, and magnetic data that should be magnetically recorded in the magnetic strip on the card C are connected to the external busses.

A sensor control unit 95*c* that controls signals from each sensor, an actuator control unit 95*d* that controls the motor driver and the like and that is configured to send the drive pulse of each motor and drive power, a thermal head control unit 95*e* that controls the thermal energy of the thermal head 51, an operation display unit 95*f* that controls the operation panel 5, and the magnetic encoder unit 80, are connected to the external busses. The sensor control unit 95*c* is connected to a card detection sensor composed of the light-emitting element 48 and light-receiving element 49 and another sensor, not shown; the actuator control unit 95*d* is connected to the stepping motor 61, the conveyance drive motor 70 and another motor, not shown, and the actuator 34, the thermal head control unit 95*e* is connected to the thermal head 51 and the operation display control unit 95*f* is connected to the operation panel 5.

Note that the power unit 90 supplies operating and drive power to the control unit 95, the thermal head 51, the operating panel 5 and the magnetic encoder unit 80. (See FIG. 7.)

The following will now explain the operations of the printer apparatus 1 according to this embodiment, and the microcomputer 95*b* CPU (hereinafter referred simply as the CPU).

When power is charged to the control unit 95, the CPU reads programs and program data stored in ROM (and expands to RAM) and conducts an initializing process that operates each mechanism. Specifically, in the initializing process, the connections of each of the control units 95*a*, and 95*c* to 95*f* of the sensor control unit 95*c* connected to the microcomputer 95*b* via the external busses and that composes the control unit 95, and of the magnetic encoder unit 80 are checked. Then a decision is made based on signals from the sensor control unit 95*c* whether each composing unit is at its home position (see FIGS. 2 and 4). If they are not at their home positions, they are moved to their home positions. If, based on the signals of the sensor control unit 95*c*, each composing element does not move to its home position after a plurality number of repeated attempts to return them to their home positions, the host apparatus 100 is notified and a message is displayed on the display unit 4 via the operation control display unit 95*f*. Also, in the initializing process, it is decided whether a card is stored in the card supply unit 10 based on signals from the sensor unit 95*c*. If there is no card, in the same way as described above, the host apparatus 100 is notified and a message is displayed on the display unit 4. The system then idles until a card is stored in the card supply unit 10.

A printer driver installed in the host apparatus 100 determines various parameters to control the recording operation at the printer apparatus 1 based on recording instructions specified by an operator (a user), then generates print recording data to record to the card C and magnetic recording data using the recording instructions. The print recording data and magnetic recording data are sent to the printer apparatus 1. Parameter values for the recording control instructions, image data and character data attained by disassembling print recording data into the color components of Y, M, C and Bk and magnetic recording data are stored in the buffer memory 95*a* of the control unit 95. Note that with this embodiment, data is disassembled into its color components (the original data is R, G, B) at the host apparatus 100 and that is converted from R, G, B to Y, M, C at the printer apparatus 1 and used as the image data. Bk data extracted at the host apparatus 100 is used as Bk data in the same way at the printer apparatus 1 to be character data.

The CPU reads the recording control instruction (parameter values) stored in the buffer memory 95*a* to control each mechanism in the following way according to the parameter values and program and program data expanded to RAM.

Initially, the actuator 34 (solenoid 34*a*) is driven (turned ON) via the actuator control unit 95*d* to move the cleaning roller 31 from its retreated position (home position) shown in FIG. 5 to the operating position shown in FIG. 4 to prepare to receive the card C. At that time, the moving mechanism 60 positions the conveyance rollers 41 and 42 at the first position (home position) to form a substantially level card conveyance path. (See the states shown in FIGS. 2 and 4.)

Next, the CPU operates the conveyance drive motor 70 via the actuator control unit 95*d* to drive each of the rollers disposed on the card conveyance path P1 via the drive transmission mechanism and drives a motor, not shown, to rotatably drive the supply roller 11 via the actuator control unit 95*d*.

Therefore, the lowermost card C of the card supply unit 10 is conveyed between the supply roller 12 and the separating gate 13 and into the casing 2 via the card supply opening 14. The printing surface of the card C is cleaned by the cleaning roller 13 and conveyed along the card conveyance path P1 toward the card conveyance out outlet 82. (See FIG. 2.) When the trailing edge of the card C is detected by the card detection sensor composed of the light-emitting element 48 and the light-receiving element 49, the CPU uses that card trailing edge detection as a trigger to stop (turn OFF) the drive of the actuator 34 (solenoid 34*a*). This cleaning roller 31 is opened by a pressing action of the lever member 35 and is moved from the operation position shown in FIG. 4 to the retreated position which is the home position shown in FIG. 5.

The card C is conveyed by the conveyance drive motor 70 over the card conveyance path P1 toward the card conveyance outlet 82 until both ends of the card C are at a position where they are nipped by the feed roller 46 and the nip roller 45. The CPU stops the conveyance drive motor 70 after the card trailing edge detection from the card detection sensor when a number of pulses of the conveyance drive motor 70 reach a predetermined value. This stops and holds the card C with both edges in a nipped state by the conveyance roller 47 and the nip roller 45. The card C is then in a state where magnetic recording data can be written to the magnetic strip by the magnetic head 81 of the magnetic encoder unit 80.

During that time, (after the detection of the card trailing edge by the card detection sensor and both edges of the card C are nipped by the feed roller 46 and nip roller 45) the CPU sends magnetic recording data stored in the buffer memory 95*a* to the magnetic encoder unit 80 (to its microcomputer) via the external busses and writes that magnetic recording data to the magnetic encoder unit 80 (to its microcomputer) when the number of pulses of the conveyance drive motor 70 reaches the predetermined value (when both edges of the card C are nipped by the conveyance roller 47 and nip roller 45).

The microcomputer of the magnetic encoder unit 80 functions as a slave computer of the CPU and writes the magnetic recording data received by scanning the magnetic head 81 from the conveyance roller 47 to the nip roller 45 to the magnetic strip on the card C. Then, the magnetic head 81 verifies the written magnetic recording data (a check that the data was written correctly) by self-propelling the magnetic head 81 in the reverse direction from the nip roller 45 to the conveyance roller 47. The results of the verification are sent to the CPU.

When, the results of the verification show that the data was written incorrectly, the CPU notifies the host apparatus 100 and displays a message to that affect on the display unit 4. The system waits until there is a conveyance out instruction to convey the card C to outside of apparatus from the host apparatus 100 and the operation panel unit 5. When the conveyance out instruction is received, the conveyance drive motor 70 is driven a predetermined number of pulses to convey the card C out of the apparatus via the card conveyance out outlet 82. Then a new card C is supplied from the card supply unit 10. In the same way, the magnetic encoder unit 80 writes magnetic recording data to the magnetic strip on the new card C and verifies that it is correctly written.

In a case where there is no problem in the results of the verification from the microcomputer of the magnetic encoder unit 80 (when magnetic recording data is correctly written to the magnetic strip on the card C), the CPU drives the conveyance drive motor 70 in reverse. This conveys the card C stopped with both edges nipped by the nip roller 45 and the feed roller 46 in a reverse direction to the card supply opening 14 along the card conveyance path P1. While the card C is being conveyed in the reverse direction, the trailing edge of the card C is detected by a transmissive type sensor composed of the light-emitting element 48 and light-receiving element 49. At that time, the conveyance drive motor 70 continues to drive in the reverse direction for a predetermined number of pulses and then stops. This causes latter half of the card C in the conveyance direction to be stopped and held in a nipped state by the conveyance rollers 42 and 43, and the leading edge of the card C in the conveyance direction to be supported by the conveyance roller 41. (See FIG. 5)

At that time, the CPU drives a motor, not shown, causing the ink ribbon R of the cartridge 52 to be taken up at the ribbon take-up reel 55. The CPU uses the time that the transmissive sensor composed of the light-emitting element 58 and light-receiving element 59 detects the edge of the ink layer Bk (black) (when the light-receiving element 59 detects a switch from a non-transmissive state of the light from the light-emitting element 58 caused by the ink layer Bk to a transmissive state), as a trigger to drive the motor, not shown, further a predetermined number of steps to set the top of the ink ribbon so that the leading edge of the ink layer Y (yellow) is positioned at the thermal head 51 and platen roller position.

Next, the CPU drives the conveyance drive motor 70 in the forward direction to convey the card C toward the card conveyance out outlet 82 over the card conveyance path P1 and at the same time verify the position of the leading edge of the card C using the card detection sensor composed of the light-emitting element 48 and the light-receiving element 49 and prints predetermined characters and images on the surface of the card C according to the print recording data using the printing unit 50. Specifically, the thermal head 51 presses against the card C surface with the ink ribbon R (the ink layer Y portion) interposed therebetween and selectively activates heating elements of the thermal head according to image data of the color Y (image data whose Y component was converted from the RGB data). This directly transfers the thermal transfer ink component of Y (yellow) coated on the ink ribbon R to the surface of the card C.

At that time, the backside of the card C is supported by the platen roller 44, but initially it is nippingly conveyed by the conveyance rollers 42 and 43 toward the card conveyance out outlet 82 over the card conveyance path P1. The leading edge of the card C is nippingly conveyed by the nip roller 45 and the trailing edge of the card C is nipping conveyed by the conveyance roller 43, and finally it is nippingly conveyed by the nip roller 45 (while the backside of the trailing edge of the card C is supported by the platen roller 44). Therefore, the conveyance rollers 42 and 43 and the nip roller 45 function as capstan rollers to nip the card C and convey the card at a constant speed when print recording using the printing unit 50. The CPU checks the position of the trailing edge of the card C with the card detection sensor composed of the light-emitting element 48 and light-receiving element 49, and continues to drive the conveyance drive motor 70 in the forward direction for a predetermined number of pulses and then the drive is stopped.

Further, the CPU drives the conveyance drive motor 70 in reverse to convey the card C in reverse along the card conveyance path P1 to the card supply opening 14. The card C is stopped and held with the front half in the conveyance direction in a nipped state by the conveyance rollers 42 and 43 and the front half in the conveyance direction supported by the conveyance roller 41. At that point, the drive of the conveyance drive motor 70 is stopped. (See FIG. 5) During this time, the CPU drives a motor, not shown, to slightly wrap the ink ribbon R of the cartridge 52 to the ribbon take-up reel 55 so that the leading edge of the ink layer M (magenta) is positioned at the thermal head 51 and platen roller 44 position. Next, the CPU drives the conveyance drive motor 70 in the forward direction to convey the card C along the card conveyance path P1 toward the card conveyance outlet 82 and directly transfers the thermal transfer ink component of the ink layer M (magenta) coated on the ink ribbon R to the surface of the card C. In the same way, the CPU directly transfers the thermal transfer ink components of the ink layers C (cyan) and Bk (black) coated on the ink ribbon R to the surface of the card C using the printing unit 50. This forms a color image on the surface of the card C using the colors of Y, M, C and Bk.

Further, the CPU conveys the card C toward the card discharge outlet 23. Specifically, when the conveyance drive motor 70 is driven in reverse, the card C is conveyed along the card conveyance path P1 in reverse toward the card supply opening 14. As shown in FIGS. 4 and 5, when sequentially print recording multiple colors onto the print surface of the card C, the conveyance rollers 41 and 42 are kept at the first position positioned to form a substantially level card conveyance path when the card C is being conveyed in reverse to the card supply opening 14 (see the state shown in FIG. 5). However, when the card C has completed the predetermined recording process and is being conveyed toward the card discharge outlet 23, using the point where the card detection sensor composed of the light-emitting element 48 and the light-receiving element 49 detects the trailing edge of the card C being conveyed in reverse over the card conveyance path P1, or when the trailing edge of the card C is detected and conveyed further a predetermined number of pulses as a trigger, the CPU controls the drive of the stepping motor 61 so the moving mechanism 60 (drive from the stepping motor 61) moves the conveyance rollers 41 and 42 to the second position positioned where it forms an oblique card conveyance path (see the state in FIGS. 3 and 6), and drives a motor, not shown in reverse to rotatably drive the supply roller 11 and rotatably drives the discharge roller 15.

With these processes, the card C will either be stored in the card storage unit 20 via the card discharge outlet 23, or it is discharged from the card discharge opening 21 to outside the apparatus (when the card storage unit 20 is full of cards). Note that when the card is discharged as shown in FIG. 6, the cleaning roller 31 is positioned at its retreated position that is at its home position separated from the card conveyance path P1 in the same state that is shown in FIG. 5.

At the point when the CPU either stores the card C in the card storage unit 20 or discharges it from the card discharge outlet 21, the reverse drives of the conveyance drive motor 70 and the motor, not shown, are stopped. Note that the CPU drives the stepping motor 61 (rotatably driven in an opposite direction) at the predetermined timing when the discharge operation to the card storage unit 20 of the card C has been completed, to recover the conveyance rollers 41 and 42 from the second position positioned to form an oblique card conveyance path to the first position positioned to form a substantially level card conveyance path. This completes the recording process to the card C. If there is a subsequent job, the operations described above are repeated.

The following will describe the effects of the printer apparatus 1 of this embodiment.

The printer apparatus 1 of this embodiment is configured so that the cleaning roller is moved by the card cleaning mechanism between the retreated position (see FIGS. 5 and 6) separated from the card conveyance path P1 and an operating position (see FIG. 4) where it touches the surface of the card C (the printing surface) being conveyed by advancing into the card conveyance path P1, and touches the surface of a roller-shaped cleaner 32. The timing for the removal of dust and dirt from the card C using the cleaning roller 31 is only when a card is supplied prior to printing at the printing unit 50. When the card C is being printed at the printing unit 50 (including when the card is being conveyed in reverse) and when the card is being discharged (with printing completed at the printing unit 50), the cleaning roller 31 is positioned at its retreated position. Because of that configuration, the cleaning roller 31 does not touch the card C immediately after the printing of each color by the printing unit 50 so print quality is ensured, and none of the colors will adhere to the surface of the cleaning roller so no unnecessary smudging of the cleaning roller 31 will occur (so print quality of the card C will not be diminished).

When the cleaning roller 31 is advanced to the operating position by the card cleaning mechanism 30, the card C surface is cleaned and the surface of the cleaning roller 31 also touches the surface of the roller-shaped cleaner 32 that has a higher adhesive nature than the cleaning roller 31 so the dust and dirt adhering thereto is transferred and handed over to the roller-shaped cleaner 32. Therefore, the cleaning roller 31 surely removes foreign matter such as dust and dirt and the like adhering to the surface of the card C and does not transfer to the card C other foreign matter such as dust and dirt and the like that was removed before. Therefore, with the printer apparatus 1 of this embodiment, the print quality of the card C is not reduced. Rather, a high quality print is possible.

Furthermore, the printer apparatus 1 of this embodiment has a configuration to allow the cleaning roller 31 and roller-shaped cleaner 32 not to be in constant contact, but to coming into and out of contact. Both of these are separated when not removing dirt from the card C (but if they are in mutual contact, they both rotate together). Since, both members are in constant contact with each other, in Pat. Pub. 2, mentioned above, they remain in contact when printing is not performed and when the power is turned off. Therefore, the following problems can exist due to the mutual adhesive nature of both members and both members being constantly in contact. 1) There can be a decrease in the ability to remove dirt because of the degradation of the adhesive; 2) there can be a decrease in the ability to remove dirt because of the transfer of adhesive from one member to the other; and 3) there can be a decrease in the ability to remove dirt because of a decrease in the closeness of the contact with the card caused by the deformation (misshapen) of the members. The printer apparatus 1 prevents these problems.

The card supply opening 14, the printing unit 50 (first recording unit) and the magnetic encoder unit 80 (second recording unit) are disposed in succession substantially horizontally along the card conveyance path P1 of the card C that is being conveyed in the printer apparatus 1 of this embodiment of the present invention. Also, the card discharge outlet 23 is provided at one side of the casing 2 so that the card supply opening 14 and the card discharge outlet 23 can be arranged in a vertical direction. For that reason, the card conveyance path does not need to be long so the apparatus can be more compact.

Also, the printer apparatus 1 of this embodiment has the conveyance rollers 41 and 42 that convey the card C, disposed between the card supply opening and the printing unit 50. A moving mechanism 60 is provided that moves the conveyance rollers 41 and 42 between a first position that forms a substantially level card conveyance path P1 to convey the card C, and a second position that conveys the card C recorded at the printing unit 50 and the magnetic encoder unit 80 toward the card discharge outlet 23. For that reason, the moving mechanism 60 moves the conveyance rollers 41 and 42 between the first position that forms the level conveyance path and the second position to convey the card C toward the card discharge outlet 23. The card conveyance path to the card discharge outlet 23 positioned below the card supply opening 14 is short to discharge the card, and the apparatus can be more compact.

The printer apparatus 1 of this embodiment is provided with a conveyance drive motor 70 that rotatably drives the conveyance rollers 41 and 42 in both the forward and reverse directions. The conveyance drive motor 70 is arranged below the printing unit 50, and between the magnetic encoder unit 80 and moving mechanism 60. For that reason, a plurality of composing units is disposed in a rational manner so the apparatus can be more compact.

The printer apparatus 1 magnetically records information to the magnetic strip on the card C at the magnetic encoder unit 80 by scanning the magnetic head over the strip. Compared to a magnetic encoder unit of the type that conveys the card C (with the magnetic head 81 stationary), this configuration increases the precision of both the printing using the printing unit 50 and magnetic recording at the magnetic encoder unit 80, and the apparatus can be more compact. The reasons for increased precision are outlined below. The print resolution of the printing unit 50 is (1) 300 dpi. The magnetic recording process to the magnetic strip on the card C by the magnetic encoder unit 80 is (2) 210 bpi (bits per inch) for one and three tracks, and (3) 75 bpi for two tracks. The lowest common multiple (the lowest common multiple of 300, 210 and 75) of (1) to (3) is 21, 000 (pulses per inch). The result of not easily attaining a lowest common multiple is that it is not possible to attain both the resolution and a compact apparatus with the magnetic encoder unit of the type that scans by conveying the card C. (It is not possible to have the motors and gear sizes used in the magnetic encoder unit adopted by the invention.) With these conditions, if the drive transmission mechanism that transmits the drive of the conveyance drive motor 70 is shared, either print precision or magnetic recording precision must be ignored to enable a compact apparatus, so either of the processing precisions is decreased. Therefore, with the printer apparatus 1 of this embodiment, the processing precision of the printing unit 50 and the magnetic encoder unit 80 are improved (or the high precision is maintained) using the scanning type magnetic head 81 of the magnetic encoder unit 80, and the overall apparatus will be more compact.

The printer apparatus 1 has a card conveyance out outlet 82 disposed on a portion of the magnetic encoder unit 80 that conveys the card C to outside of the casing 2, at the other side of the casing 2 opposing the card supply opening 14. For that reason, other than using the card discharge outlet 23, it is also possible to discharge the card C from the card conveyance out outlet 82, thereby improving convenience for users.

In the printer apparatus 1 of this embodiment, the roller-shaped cleaner 32 that removes dirt from the surface of the cleaning roller 31 is fastened to a portion of the cartridge 52. For that reason, the roller-shaped cleaner 32 can be replaced by replacing the cartridge, thereby improving usability.

An example is provided where the holder 33, in the card cleaning mechanism 30, that holds the cleaning roller is indirectly pressed downward to position the cleaning roller 31 at the operating position, but the present invention is not limited to that configuration. It is also acceptable to position (move) the cleaning roller 31 to the operating position by the actuator 34 (plunger 34*b*) directly pressing the holder 33. In this embodiment, an example is provided for an actuator composed of a solenoid as a drive unit and a plunger. However, the present invention is not limited to this configuration and can also use a rotating motor or a direct motor.

This embodiment provided an example of a card that has a magnetic strip and a magnetic encoder unit 80, but these are not to be construed as restrictions to the present invention. For example, it is acceptable to use and IC card and to write information either through contact or non-contact to the IC card. Also, an example has been provided in this embodiment to print with the printing unit 50 after magnetically recording with the magnetic encoder unit 80 to reduce costs incurred when recording is poor, but that is not to be considered a limitation to the present invention. It is also possible to magnetically record at the magnetic encoder unit 80 after printing at the printing unit 50, and to conduct the recording process at either the printing unit 50 or the magnetic encoder unit 80. An example was described in this embodiment of a system configured with the host apparatus 100, but it is also acceptable to equip the printing unit 50 with a media reading unit to read data recorded on an MO, CD or DVD and the like, and to enable operation of the printer apparatus 1 according to recording operation instructions from the operation panel 5.

Furthermore, an example was explained to discharge the card C from the card conveyance out outlet 82 when writing to the magnetic strip on the card C is improper, but it is also acceptable to convey the card C to the card discharge outlet 23 to discharge the card C at the card discharge outlet 23, and to convey the printed card C along the card conveyance path P1 and discharge it from the card conveyance out outlet 82.

An example was explained to print using the colors of Y, M, C, and Bk in the printing process at the printing unit 50, but the present invention is not limited thereto and can also print using only Bk.

What is claimed is:

1. A card printing apparatus for sequentially printing a plurality of colors on a card, comprising:

a card supply unit for supplying the card;

a card conveyance path provided linearly from the card supply unit to convey the card;

a conveyance device provided on the card conveyance path for conveying the card;

a printing unit provided on the card conveyance path, the printing unit printing a first color while conveying the card and printing a next color while conveying the card in a reverse direction after positioning the card;

a card cleaning member disposed between the card supply unit and the printing unit within a returning range of the card while printing the card conveyed in reverse, the card cleaning member contacting the card supplied from the card supply unit and cleaning the card;

a holder for holding the card cleaning member; and a card cleaning member moving device having an actuator, the actuator moving the holder holding the card cleaning member between a retreated position spaced from the card conveyance path where the card cleaning member does not contact a surface of the card being conveyed, and an operating position where the card cleaning member contacts the surface of the card being conveyed by advancing into the card conveyance path, wherein the card cleaning member is moved to the retreated position when the card is conveyed in reverse while printing wherein the holder is detachably attached to the card printing apparatus, the actuator comprises a solenoid, a plunger attached to the solenoid to project from or retract into the solenoid by an actuation of the solenoid, a lever member rotationally attached to the plunger at one end, and an engaging member engaging the other end of the lever member, the holder detachably engaging the engaging member, and the holder and the engaging member include convex and concave portions engaging each other, respectively, so that the holder is attached to or detached from the engaging member by insertion.

2. A card printing apparatus according to claim 1, further comprising:

a card discharging member disposed under the card supply unit and discharging the card printed, and a moving mechanism for moving a part of the conveyance device to form a discharging path to discharge the card from the card discharging member, wherein the moving mechanism moves the conveyance device in between a level conveyance path to print and supply cards, and an oblique conveyance path to discharge a printed card.

3. A card printing apparatus according to claim 2, wherein the card cleaning member comprises a cleaning roller having an adhesiveness;

the conveyance device comprises a conveyance roller conveying the card; and the conveyance roller and the cleaning roller convey the card by nipping the card in a condition that the conveyance roller is positioned in the level conveyance path, and the cleaning roller is positioned in the operating position.

4. A card printing apparatus according to claim 3, wherein said card cleaning member further comprises a cleaner contacting the cleaning roller only when the cleaning roller is in the operation position, to thereby remove dirt adhered to the cleaning roller, the cleaner being disposed away from the card conveyance path.

5. A card printing apparatus according to claim 1, wherein the card cleaning member is moved to the operating position when the card is supplied.

6. A card printing apparatus according to claim 1, wherein the actuator is positioned at a side of the card cleaning member relative to the card conveyance path.

* * * * *